US008205286B1

(12) United States Patent
Diaz

(10) Patent No.: US 8,205,286 B1
(45) Date of Patent: Jun. 26, 2012

(54) PILLOW FOR FEMALE BREASTS

(76) Inventor: Milagros Diaz, Pembroke Pines, FL (US)

( * ) Notice: Subject to any disclaimer, the term of this patent is extended or adjusted under 35 U.S.C. 154(b) by 83 days.

(21) Appl. No.: 12/946,947

(22) Filed: Nov. 16, 2010

Related U.S. Application Data

(63) Continuation-in-part of application No. 12/221,585, filed on Oct. 21, 2008, now abandoned, and a continuation-in-part of application No. 12/587,335, filed on Dec. 14, 2009, now abandoned.

(51) Int. Cl.
*A47C 17/00* (2006.01)

(52) U.S. Cl. ..... 5/735; 5/652; 5/630

(58) Field of Classification Search ..... 5/630, 735, 5/652, 655.9, 631, 632
See application file for complete search history.

(56) References Cited

U.S. PATENT DOCUMENTS

| | | | | | |
|---|---|---|---|---|---|
| 2,933,738 | A * | 4/1960 | Whelan | 5/630 |
| 3,118,152 | A * | 1/1964 | Talley, Jr. | 5/631 |
| 3,967,335 | A * | 7/1976 | Rhoads | 5/632 |
| 4,596,384 | A * | 6/1986 | Blosser | 5/613 |
| 5,661,860 | A * | 9/1997 | Heitz | 5/632 |
| 5,819,348 | A * | 10/1998 | Ryan | 5/735 |
| 6,408,468 | B1 * | 6/2002 | Comfort | 5/636 |
| 6,857,145 | B1 * | 2/2005 | Sikes | 5/110 |
| 6,934,988 | B1 * | 8/2005 | Wetzler et al. | 5/621 |
| 7,597,104 | B2 * | 10/2009 | Zheng et al. | 128/869 |
| D628,298 | S * | 11/2010 | Rubio | D24/183 |
| 2007/0089240 | A1 * | 4/2007 | Dazzi | 5/630 |
| 2010/0011508 | A1 * | 1/2010 | Rubio | 5/632 |

* cited by examiner

*Primary Examiner* — William Kelleher
(74) *Attorney, Agent, or Firm* — Albert Bordas, P.A.

(57) ABSTRACT

A pillow for female breasts, comprising a pillow comprising a first lateral wall, and top and bottom walls. The top wall has first and second openings. The first and second openings receive each breast of a woman when lying thereon. A protective cover comprises a first upper portion, a bottom portion, and a second lateral wall. The first upper portion has first and second interior sidewalls that align with and fit within the first and second openings respectively. An outer cover comprises a second upper portion and a third lateral wall. The second upper portion has first and second pocket members that align with and fit within the first and second interior sidewalls that in turn align with and fit within the first and second openings respectively. The protective cover is dressed on the pillow, and the outer cover is dressed on the protective cover and the pillow.

2 Claims, 4 Drawing Sheets

PILLOW FOR FEMALE BREASTS

OTHER RELATED APPLICATIONS

The present application is a continuation-in-part of pending U.S. patent application Ser. No. 12/221,585, filed on Oct. 21, 2008, and pending U.S. patent application Ser. No. 12/587,335 filed on Dec. 14, 2009, which are hereby incorporated by reference.

BACKGROUND OF THE INVENTION

1. Field of the Invention

The present invention relates to pillows, and more particularly, to a pillow that offers comfort and support for woman's breasts when lying face down on a surface such as a bed.

2. Description of the Related Art

Many women lying on their stomachs can become uncomfortable due to pressure placed on the breasts. Some women with naturally large breasts or with implants would enjoy sleeping on the stomach, but are unable due to the extreme discomfort. Should a patient of recent surgery find herself on her stomach, she may damage the outcome of breast augmentation. Without a protective way to comfort the breasts while lying on their stomach, women must remain on their back or their side. Additional discomfort may occur during menstrual cycles or nursing when the breasts become sore and tender.

Applicant believes that one of the closest references corresponds to U.S. Patent Application Publication No. 2007/0089240 A1 published on Apr. 26, 2007 to Dazzi for a pillow suitable for women's body. However, it differs from the present invention because Dazzi teaches a pillow (1) suitable for women's body, allowing an easy resting to women's chest, keeping breasts separated therebetween and raised, unflattened by the body. The pillow has a donut shape additionally allowing an effective body side support, and it comprises: a substantially oval annular pillow main body (2), having a central opening allowing breast insertion and a resting surface (3) for the chest area surrounding the breast; a pillow secondary body (4) of elongate shape, located transversely to the opening of the main body (2) so as to position itself between the breasts, at the sternum.

SUMMARY OF THE INVENTION

The instant invention offers women with a more comfortable way to lie on their stomach, as it would accommodate their breasts. The present invention, defined as a pillow, enables any woman to lie on her stomach to sleep by gently accommodating her breasts inside strategic openings. The instant invention prevents pain and discomfort often associated with lying on the stomach. The present invention is ideal for women with large breasts, post-partum for nursing to alleviate discomfort when lying on the stomach, painful breasts during menstrual cycles, reconstructed breasts and those with cosmetic implants, etc. Humans spend one-third of a lifetime sleeping and the instant invention offers comfort and support for a more restful nights sleep.

More specifically, the instant invention is a female breast pillow, comprising a pillow comprising a first lateral wall, and top and bottom walls. The top wall has first and second lateral ends, and first and second openings that extend from the top wall to the bottom wall. The first and second openings have a first cooperative shape and dimension to snugly receive each breast of a woman when lying thereon. A protective cover comprises a first upper portion, a bottom portion, and a second lateral wall. The first upper portion has first and second interior sidewalls that align with and fit within the first and second openings respectively. The first and second interior sidewalls each have respective first and second ends comprising first and second elastic bands. An outer cover comprises a second upper portion and a third lateral wall. The third lateral wall extends to the second upper portion and extends beyond the first lateral wall of the pillow. The third lateral wall comprises a third end having a third elastic band. The second upper portion has first and second pocket members that align with and fit within the first and second interior sidewalls that in turn align with and fit within the first and second openings respectively. The protective cover is dressed on the pillow, and the outer cover is dressed on the protective cover and the pillow.

The bottom wall is flat and the first and second lateral ends curve upwardly from the top wall to conform to a body of the woman. The pillow is made of a soft flexible material to relieve and/or eliminate pressure upon each the breast when lying facedown for a more comfortable rest. The third lateral wall extends beyond the first lateral wall of the pillow without covering the bottom wall completely. The first and second pocket members are nets made of a resilient and soft material to comfortably adapt to each breast.

It is therefore one of the main objects of the present invention to provide a pillow to accommodate female breasts that allows for comfort when a user is lying on her stomach.

It is another object of this invention to provide a pillow to accommodate female breasts created specifically for women, thus comprising two openings through which the woman's breasts fit.

It is another object of this invention to provide a pillow to accommodate female breasts that cradles breasts, thus providing a simple way to relax on any bed while offering support to the user's upper torso.

It is another object of this invention to provide a pillow to accommodate female breasts with openings of a variety of sizes.

It is another object of this invention to provide a pillow to accommodate female breasts that eliminates pressure when lying on the chest, thus providing a more comfortable rest.

It is another object of this invention to provide a pillow to accommodate female breasts that is made of a soft flexible material.

It is another object of this invention to provide a non-toxic pillow to accommodate female breasts after breast-feeding, when breast tenderness occurs during a monthly cycle, post breast implant cosmetic surgery, when laying or sleeping in a prone position, during a massage, and/or undergoing a surgical procedure, which requires prolonged length of time laying face down, etc.

It is another object of this invention to provide a pillow to accommodate female breasts that is ultra-light and volumetrically efficient for carrying, transporting, and storage.

It is another object of this invention to provide a pillow to accommodate female breasts that is of a durable and reliable construction.

It is yet another object of this invention to provide such a pillow that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
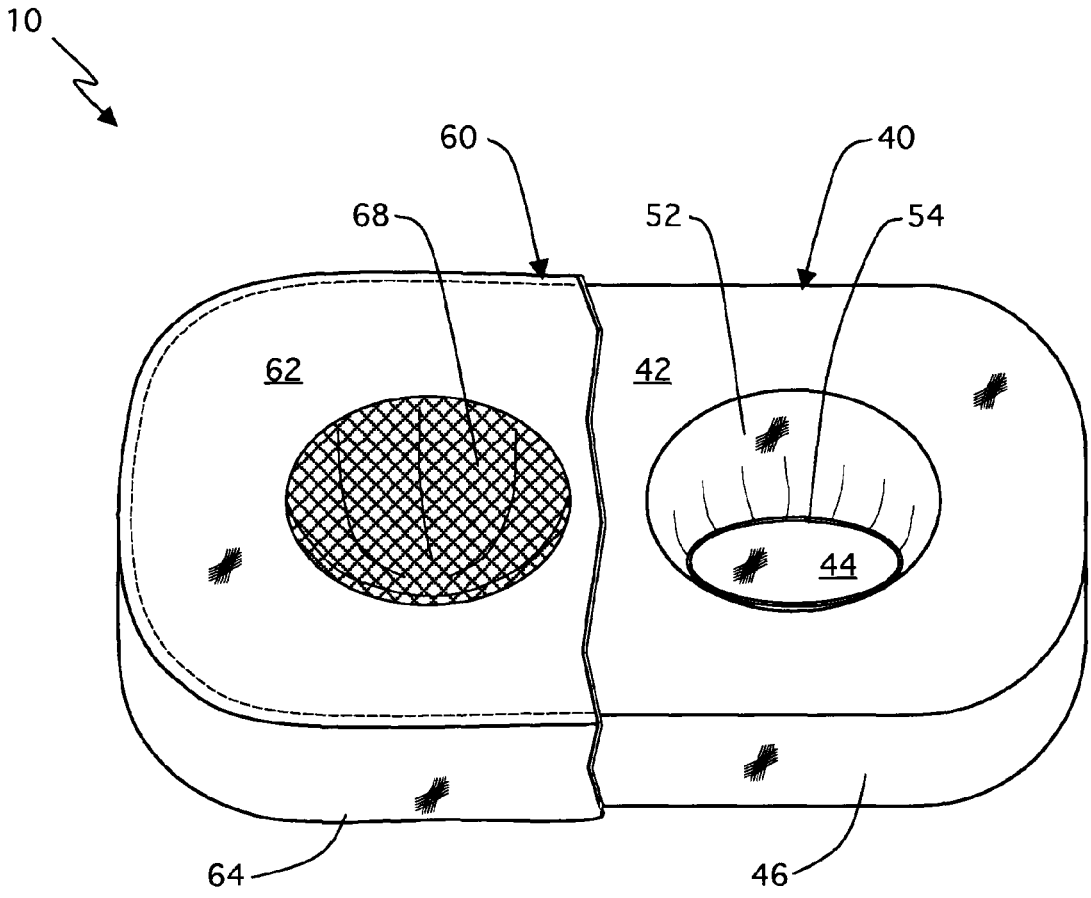
FIG. 1 is a top view of instant invention 10 with outer cover 60 partially removed to illustrate protective cover 40 dressed on pillow 20.

Referring now to the drawings, the present invention is defined as a pillow for female breasts, and is generally referred to with numeral 10.

As seen in FIG. 1, pillow for female breasts 10 has a substantially pillow shape, and basically includes pillow 20, protective cover 40, and outer cover 60. Protective cover 40 is dressed on or covers pillow 20, and outer cover 60 is dressed on or covers protective cover 40 and pillow 20.

Figure 2A:
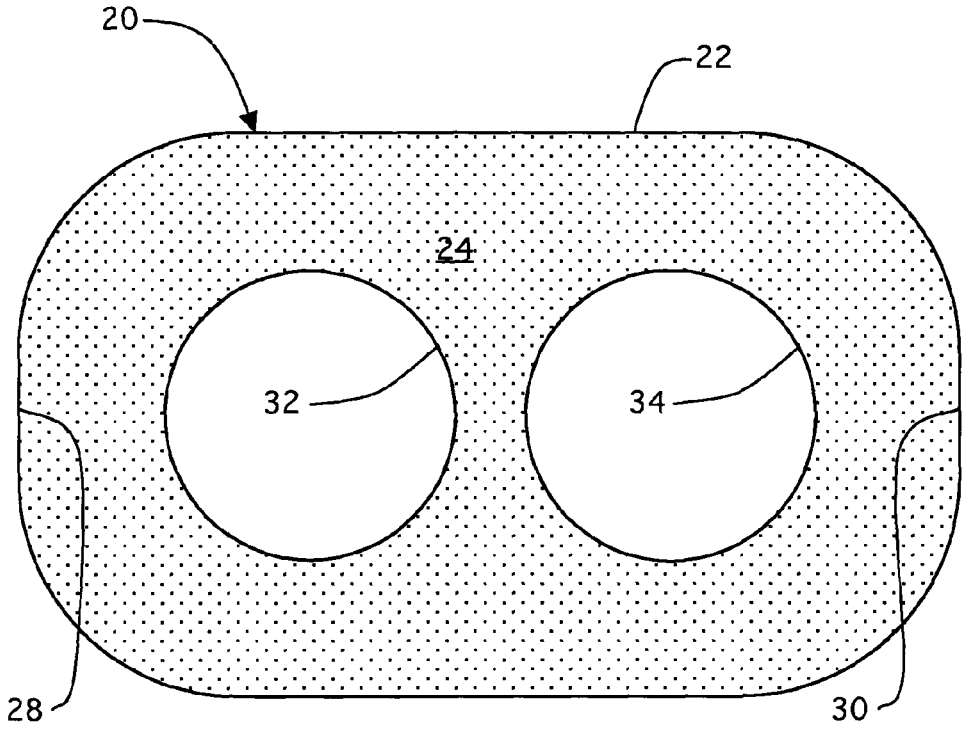
FIG. 2A is a top view of pillow 20.
Figure 2B:
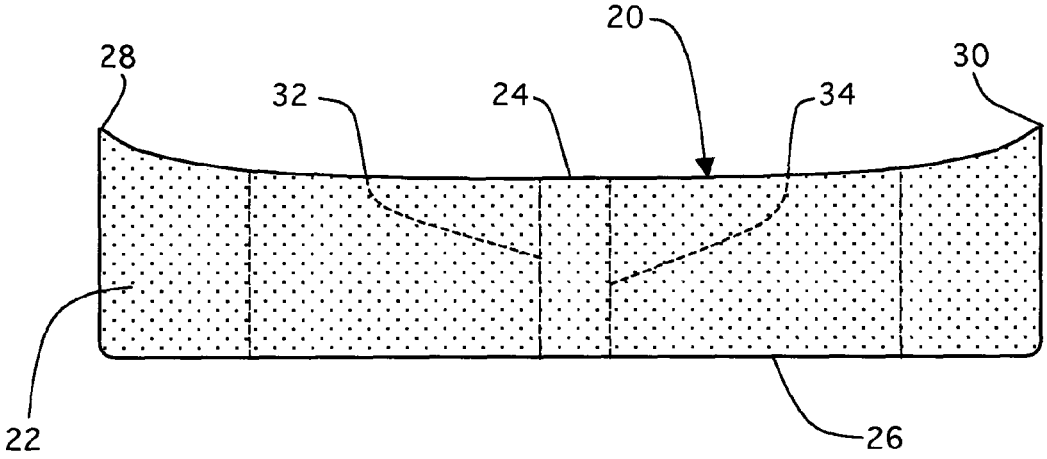
FIG. 2B is a side view of pillow 20.

As seen FIGS. 2A and 2B, pillow 20 comprises lateral wall 22, and top and bottom walls 24 and 26 respectively. Top wall 24 has lateral ends 28 and 30. Openings 32 and 34 extend from top wall 24 to bottom wall 26, and have a cooperative shape and dimension to snugly receive each breast when a woman lies thereon. Pillow 20 is made of a soft flexible material to relieve and/or eliminate pressure upon the breasts when lying facedown for a more comfortable rest. In a preferred embodiment, bottom wall 26 is flat and lateral ends 28 and 30 curve upwardly from top wall 24 to conform to a woman's body.

Figure 3A:
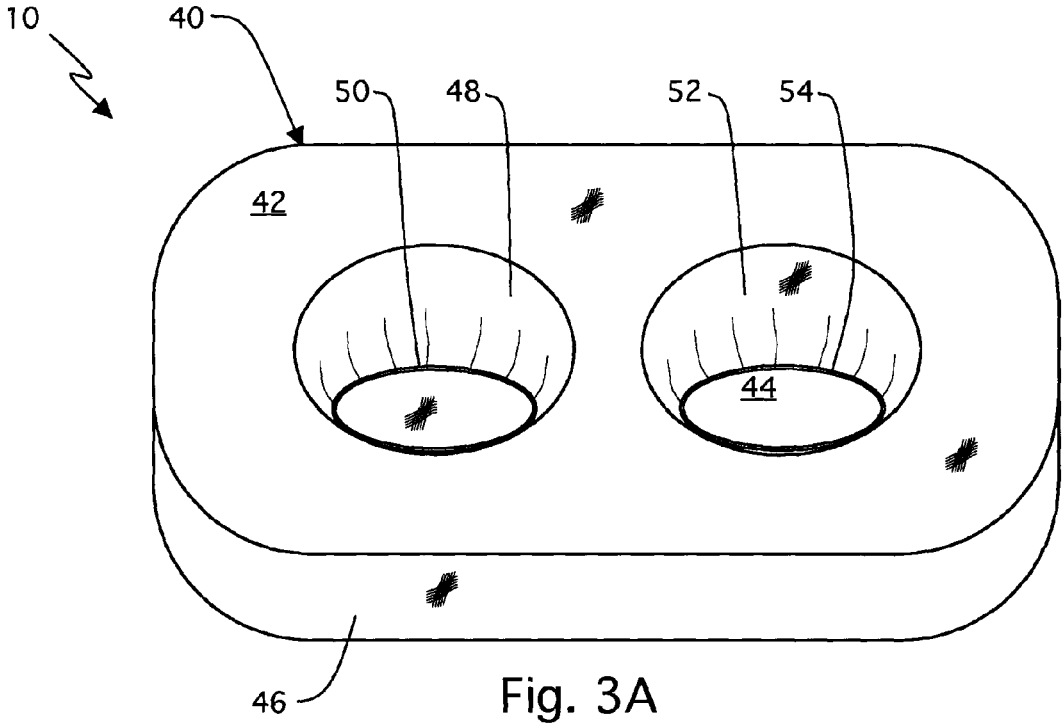
FIGS. 3A and 3B are isometric views of outer cover 60 removed from protective cover 40 dressed on pillow 20.
Figure 3B:
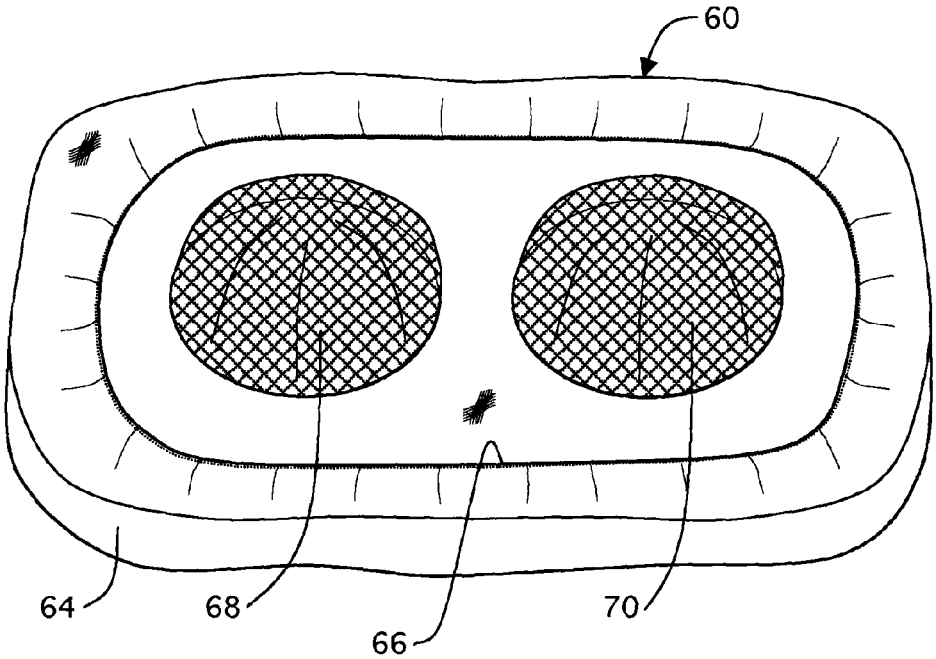
Figure 4:
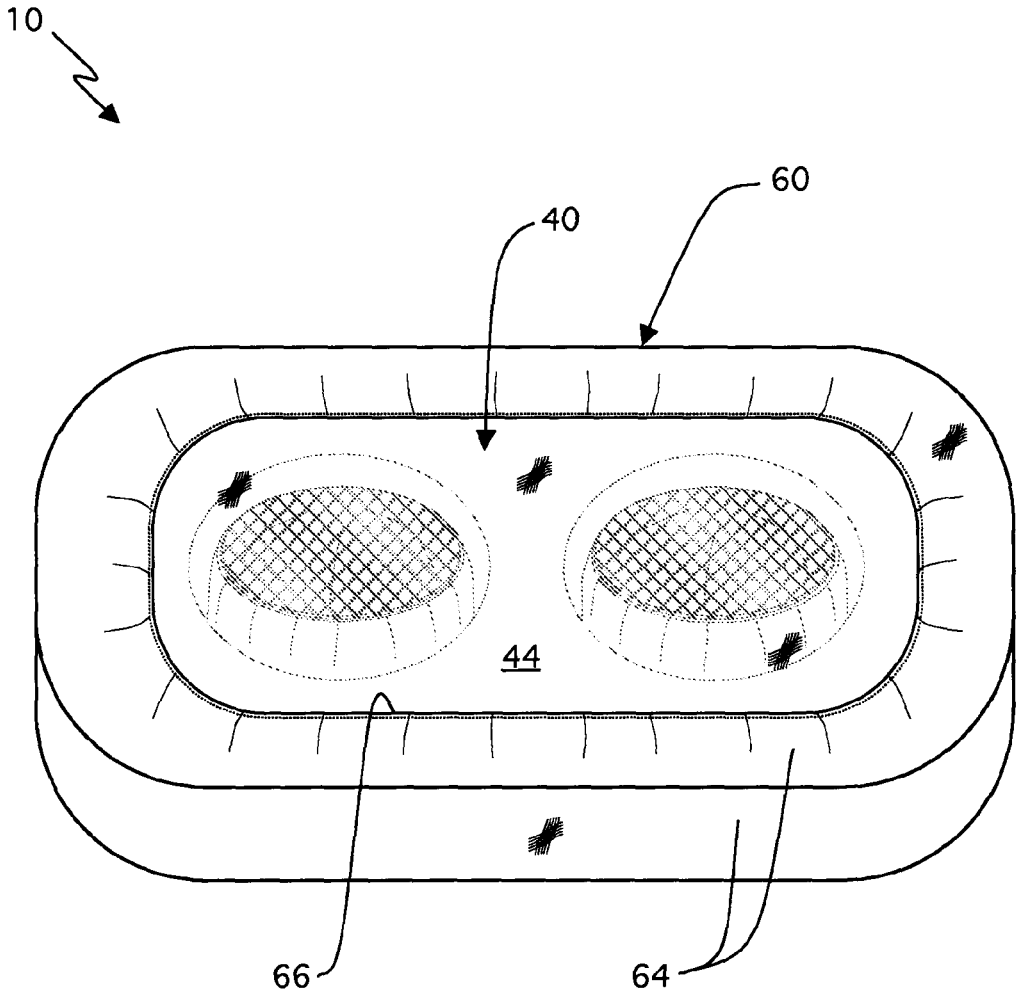
FIG. 4 is a bottom view of instant invention 10 with outer cover 60 dressed on protective cover 40 that is dressed on pillow 20.

As seen in FIGS. 3 and 4, protective cover 40 is dressed on or covers pillow 20. Protective cover 40 comprises upper portion 42, bottom portion 44, and lateral wall 46. Upper portion 42 has interior sidewalls 48 and 52 that align with and fit within openings 32 and 34 respectively. Interior sidewall 48 comprises elastic band 50 at its end, and interior sidewall 52 comprises elastic band 54 at its end. Protective cover 40 is made of a soft and flexible material, such as polyester and/or cotton.

Outer cover 60 is dressed on or covers protective cover 40 and pillow 20. Outer cover 60 comprises upper portion 62, seen in FIG. 1, and lateral wall 64. In a preferred embodiment, lateral wall 64 is sewn to upper portion 62, and extends beyond lateral wall 22 of pillow 20. It is noted that lateral wall 64 does not cover bottom wall 26 completely. Lateral wall 64 comprises elastic band 66 at its end. Upper portion 62 has pocket members 68 and 70 that align with and fit within interior sidewalls 48 and 52 that in turn align with and fit within openings 32 and 34 respectively. In a preferred embodiment, pocket members 68 and 70 are nets made of a resilient and soft material to comfortably adapt to the shape of the user's breasts. Outer cover 60 is easy to remove for washing and to dress protective cover 40. Outer cover 60 is also made of soft and flexible material, such as polyester and/or cotton.

In use lying facedown, a user's upper-torso body weight is not upon the breasts themselves, but on instant invention 10. It is specially designed, allowing for comfort when lying on the stomach. It was created specifically for women, thus accommodate for breasts. Pocket members 68 and 70 that align with and fit within interior sidewalls 48 and 52 that in turn align with and fit within openings 32 and 34 can be any size to accommodate different breast sizes including cup size. In use, instant invention 10 causes lifting of the user's chest and offers support to the upper torso of the user, and cradles the breasts. Thus, providing a simple way to relax on any bed or surface. Instant invention 10 eliminates pressure while lying on the chest, inviting the user to rest more comfortably. In a preferred embodiment, instant invention 10 measures approximately 19" in length×12" width×3.5" center×3" deep for a standard pillow. As an example, larger measurements may be 20" in length×12" width×3.5 center×4" deep.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A pillow for female breasts, comprising:

A) a pillow comprising a first lateral wall, and top and bottom walls, said top wall has first and second lateral ends, and first and second openings that extend from said top wall to said bottom wall, said first and second openings have a first cooperative shape and dimension to snugly receive each breast of a woman when lying thereon, said bottom wall is flat and said first and second lateral ends curve upwardly from said top wall to conform to a body of said woman, said pillow is made of a soft flexible material to relieve and/or eliminate pressure upon each said breast when lying facedown for a more comfortable rest;

B) a protective cover comprising a first upper portion, a bottom portion, and a second lateral wall, said first upper portion has first and second interior sidewalls that align with and fit within said first and second openings respectively, said first and second interior sidewalls each have respective first and second ends comprising first and second elastic bands, said first and second interior sidewalls converge to third and fourth openings, said third and fourth openings are surrounded by said first and second elastic bands; and C) an outer cover comprising a second upper portion and a third lateral wall, said third lateral wall extends to said second upper portion and extends beyond said first lateral wall of said pillow, said third lateral wall comprises a third end having a third elastic band, said second upper portion has first and second pocket members that align with and make contact with said first and second interior sidewalls respectively when they fit within said first and second interior sidewalls that in turn align with and fit within said first and second openings respectively, said third lateral wall extends beyond said first lateral wall of said pillow without covering said bottom wall completely, said protective cover is dressed on said pillow, and said outer cover is dressed on said protective cover and said pillow, said first and second pocket members are nets made of a resilient and soft material to comfortably adapt to each said breast.

2. A pillow for female breasts, consisting of:

A) a pillow comprising a first lateral wall, and top and bottom walls, said top wall has first and second lateral ends, and first and second openings that extend from said top wall to said bottom wall, said first and second openings have a first cooperative shape and dimension to snugly receive each breast of a woman when lying thereon, said bottom wall is flat and said first and second lateral ends curve upwardly from said top wall to conform to a body of said woman, said pillow is made of a soft flexible material to relieve and/or eliminate pressure upon each said breast when lying facedown for a more comfortable rest;

B) a protective cover comprising a first upper portion, a bottom portion, and a second lateral wall, said first upper portion has first and second interior sidewalls that align with and fit within said first and second openings respectively, said first and second interior sidewalls each have respective first and second ends comprising first and second elastic bands, said first and second interior sidewalls converge to third and fourth openings, said third and fourth openings are surrounded by said first and second elastic bands; and C) an outer cover comprising a second upper portion and a third lateral wall, said third lateral wall extends to said second upper portion and extends beyond said first lateral wall of said pillow, said third lateral wall comprises a third end having a third elastic band, said second upper portion has first and second pocket members that align with and make contact with said first and second interior sidewalls respectively when they fit within said first and second interior sidewalls that in turn align with and fit within said first and second openings respectively, said third lateral wall extends beyond said first lateral wall of said pillow without covering said bottom wall completely, said protective cover is dressed on said pillow, and said outer cover is dressed on said protective cover and said pillow, said first and second pocket members are nets made of a resilient and soft material to comfortably adapt to each said breast.

* * * * *